US009850562B2

(12) United States Patent
Urata et al.

(10) Patent No.: US 9,850,562 B2
(45) **Date of Patent: *Dec. 26, 2017**

(54) FE-BASED NANO-CRYSTALLINE ALLOY

(71) Applicants: TOKIN CORPORATION, Sendai-shi, Miyagi (JP); Tohoku Magnet Institute Co., Ltd, Sendai-shi, Miyagi (JP)

(72) Inventors: Akiri Urata, Sendai (JP); Yasunobu Yamada, Sendai (JP); Hiroyuki Matsumoto, Sendai (JP); Shigeyoshi Yoshida, Sendai (JP); Akihiro Makino, Sendai (JP)

(73) Assignees: TOHOKU MAGNET INSTITUTE CO., LTD, Sendai-Shi, Miyagi (JP); TOKIN CORPORATION, Sendai-Shi, Miyagi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/054,446

(22) Filed: Feb. 26, 2016

(65) Prior Publication Data

US 2016/0177429 A1 Jun. 23, 2016

Related U.S. Application Data

(62) Division of application No. 13/392,441, filed as application No. PCT/JP2010/062155 on Jul. 20, 2010, now Pat. No. 9,287,028.

(30) Foreign Application Priority Data

Aug. 24, 2009 (JP) ..... 2009-192887
Jun. 4, 2010 (JP) ..... 2010-129250

(51) Int. Cl.
*C22C 45/02* (2006.01)
*C21D 6/00* (2006.01)
(Continued)

(52) U.S. Cl.
CPC ..... *C22C 45/02* (2013.01); *B22F 1/0044* (2013.01); *B22F 1/0048* (2013.01); *C21D 6/00* (2013.01);
(Continued)

(58) Field of Classification Search
CPC ..... B22F 11/0048; B22F 1/0044; C21D 2201/03; C21D 6/00; C22C 33/003
(Continued)

(56) References Cited

U.S. PATENT DOCUMENTS 6,425,960 B1 7/2002 Yoshizawa et al.
8,177,923 B2 5/2012 Ohta et al.
(Continued)

FOREIGN PATENT DOCUMENTS

CN 101194039 A 6/2008
CN 101263240 A 9/2008
(Continued)

OTHER PUBLICATIONS

Chinese Office Action dated Aug. 1, 2014 issued in counterpart Chinese Application No. 201080024778.6.
(Continued)

*Primary Examiner* — Jie Yang
(74) *Attorney, Agent, or Firm* — Holtz, Holtz & Volek PC

(57) ABSTRACT

An Fe-based nano-crystalline alloy formed from an alloy composition of $(FeE)_{(100-X-Y-Z)}B_XP_YCu_Z$ having an amorphous phase as a main phase, wherein 79≤100-X-Y-Z≤86 atomic %, 4≤X≤9 atomic %, 1≤Y≤10 atomic %, and 0.5≤Z<1.2 atomic %, and wherein (FeE) includes Fe and at least one element selected from the group consisting of Ti, Zr, Hf, Nb, Ta, Mo, W, Cr, Al, Mn, Ag, Zn, Sn, As, Sb, Bi, Y, N, O and a rare-earth element, wherein a combined total of said at least one element selected from the group consisting of Ti, Zr, Hf, Nb, Ta, Mo, W, Cr, Al, Mn, Ag, Zn, Sn,
(Continued)

As, Sb, Bi, Y, N, O and a rare-earth element is in an amount of 3 atomic % or less relative to the whole composition.

3 Claims, 2 Drawing Sheets

(51) Int. Cl.
*C22C 33/00* (2006.01)
*H01F 1/153* (2006.01)
*B22F 1/00* (2006.01)

(52) U.S. Cl.
CPC ..... *C22C 33/003* (2013.01); *H01F 1/15308* (2013.01); *H01F 1/15333* (2013.01); *C21D 2201/03* (2013.01)

(58) Field of Classification Search
USPC ..... 148/579
See application file for complete search history.

(56) References Cited

U.S. PATENT DOCUMENTS

| | | | |
|---|---|---|---|
| 2009/0266448 | A1 | 10/2009 | Ohta et al. |
| 2010/0084056 | A1 | 4/2010 | Ohta et al. |
| 2010/0097171 | A1 | 4/2010 | Urata et al. |

FOREIGN PATENT DOCUMENTS

| | | | |
|---|---|---|---|
| EP | 1840906 | A1 | 10/2007 |
| EP | 1925686 | A1 | 5/2008 |
| EP | 2149616 | A1 | 2/2010 |
| JP | 2006241569 | A | 9/2006 |
| JP | 2007107095 | A | 4/2007 |
| JP | 2007231415 | A | 9/2007 |
| JP | 2007270271 | A | 10/2007 |
| JP | 2008231463 | A | 10/2008 |
| RU | 2009254 | C1 | 3/1994 |
| SU | 1790623 | A3 | 1/1993 |
| UA | 19217 | A | 12/1997 |
| WO | 9838348 | A1 | 9/1998 |
| WO | 2008068899 | A1 | 6/2008 |
| WO | 2008114605 | A1 | 9/2008 |
| WO | 2008114665 | A1 | 9/2008 |
| WO | 2008129803 | A1 | 10/2008 |
| WO | 2008133301 | A1 | 11/2008 |
| WO | 2008133302 | A1 | 11/2008 |

OTHER PUBLICATIONS

Russian Office Action dated Jun. 7, 2012 (and English translation thereof) in counterpart Russian Application No. 2012107856/02.
Russian Decision to Grant dated Oct. 8, 2012 (and English translation thereof) in counterpart Russian Application No. 2012107856/02.
Japanese Office Action dated Jan. 13, 2011 (and English translation thereof) in counterpart Japanese Application No. 2010-536246.
Japanese Office Action dated May 12, 2011 (and English translation thereof) in counterpart Japanese Application No. 2010-536246.
International Search Report dated Oct. 26, 2010 issued in International Appln. No. PCT/JP2010/062155.
Supplementary European Search Report dated Apr. 5, 2013 for EP 10811631.
Chinese Office Action dated Jun. 20, 2016, issued in counterpart Chinese Application No. 201510101184.5.
Extended European Search Report dated Sep. 28, 2016 issued in counterpart European Application No. 16175088.0.
Indian Office Action (in English) dated Jan. 20, 2017 issued in Indian Application No. 2054/CHENP/2012.

FE-BASED NANO-CRYSTALLINE ALLOY

This application is a Divisional Application of U.S. Ser. No. 13/392,441, filed Feb. 24, 2012 (U.S. Pat. No. 9,287,028 issued Mar. 16, 2016), which is a U.S. National Phase Application under 35 USC 371 of International Application PCT/JP2010/062155 filed Jul. 20, 2010, the entire contents of both of which are incorporated herein by reference.

TECHNICAL FIELD

This invention relates to a soft magnetic alloy and a forming method thereof, wherein the soft magnetic alloy is suitable for use in a transformer, an inductor, a magnetic core included in a motor, or the like.

BACKGROUND ART

A kind of soft magnetic amorphous alloy is disclosed in Patent Document 1. Patent Document 1 discloses an Fe—B—P-M (M is Nb, Mo or Cr) based soft magnetic amorphous alloy. This soft magnetic amorphous alloy has superior soft magnetic properties. This soft magnetic amorphous alloy has a lower melting temperature as compared with a commercial Fe-based amorphous alloy so that it is possible to easily form an amorphous phase. Moreover, this soft magnetic amorphous alloy is suitable as a dust material.

Patent Document 1: JP-A 2007-231415

DISCLOSURE OF INVENTION

Problem(s) to be Solved by the Invention

However, as for the soft magnetic amorphous alloy of JP-A 2007-231415, use of non-magnetic metal element such as Nb, Mo or Cr causes a problem that saturation magnetic flux density Bs is lowered. There is also a problem that the soft magnetic amorphous alloy of JP-A 2007-231415 has saturation magnetostriction of $17\times10^{-6}$ which is larger as compared with other soft magnetic material such as Fe, Fe—Si, Fe—Si—Al or Fe—Ni.

It is therefore an object of the present invention to provide an soft magnetic alloy, which has high saturation magnetic flux density and low saturation magnetostriction, and a method of forming the soft magnetic alloy.

Means to Solve the Problem

As a result of diligent study, the present inventors have found that a specific alloy composition of Fe—B—P with Cu additive, which has an amorphous phase as a main phase, can be used as a starting material for obtaining an Fe-based nano-crystalline alloy.

Especially, by using P and B, where a eutectic composition of Fe—P or Fe—B has high Fe content, as essential elements, it is possible to lower a melting temperature in spite of the high Fe content. In detail, the specific alloy composition is represented by a predetermined composition and has an amorphous phase as a main phase. This specific alloy composition is exposed to a heat-treatment so that nanocrystals comprising no more than 25 nm of bcc Fe can be crystallized. Thus, it is possible to increase saturation magnetic flux density and to lower saturation magnetostriction of an Fe-based nano-crystalline alloy.

One aspect of the present invention provides an alloy composition of $Fe_{(100-X-Y-Z)}B_XP_YCu_Z$, where $4\leq X\leq14$ atomic %, $0\leq Y\leq10$ atomic %, and $0.5\leq Z\leq2$ atomic %.

General industrial material such as Fe—Nb is expensive. Moreover, the industrial material contains a large amount of impurities such as Al and Ti. If a certain amount of the impurities is mixed to the industrial material, capability of forming an amorphous phase and soft magnetic properties may be degraded considerably.

Therefore, there is a need for a soft magnetic alloy which is formable stably even if an industrial material having a large amount of impurities is used, and which is suitable for industrialization.

As a result of study to answer the aforementioned need, the present inventors have found that, even if an inexpensive industrial material is used, it is possible to easily form the alloy composition when the amounts of Al, Ti, Mn, S, O and N in the alloy composition are within respective predetermined ranges.

Another aspect of the present invention provides the alloy composition of $Fe_{(100-X-Y-Z)}B_XP_YCu_Z$, where $4\leq X\leq14$ atomic %, $0\leq Y\leq10$ atomic %, and $0.5\leq Z\leq2$ atomic %, wherein the alloy composition containing Al of 0.5 wt % or less (including zero), Ti of 0.3 wt % or less (including zero), Mn of 1.0 wt % or less (including zero), S of 0.5 wt % or less (including zero), O of 0.3 wt % or less (excluding zero), N of 0.1 wt % or less (including zero).

Effect(s) of the Invention

The Fe-based nano-crystalline alloy, which is formed by using the alloy composition according to the present invention as a starting material, has high saturation magnetic flux density and low saturation magnetostriction so that it is suitable for miniaturization of a magnetic component and increasing of performance of the magnetic component.

Moreover, the alloy composition according to the present invention has only four elements as essential elements so that it is easy, in mass production, to control the composition of the essential elements and to control the impurities.

Moreover, the alloy composition according to the present invention has a low melting (starting) temperature so that it is easy to melt the alloy and to form amorphous. Therefore, it is possible to form the alloy composition by an existing apparatus while reducing the load of the existing apparatus.

Moreover, the alloy composition according to the present invention also has low viscosity in a molten state. Therefore, when the alloy composition is formed in a powder form, it is easy to form spherical fine powders and to form amorphous.

Moreover, when the amounts of Al, Ti, Mn, S, O and N in the alloy composition are within the respective ranges provided by the present invention, it is possible to form the alloy composition easily even if an inexpensive industrial material is used.

BEST MODE FOR CARRYING OUT THE INVENTION

Figure 1:
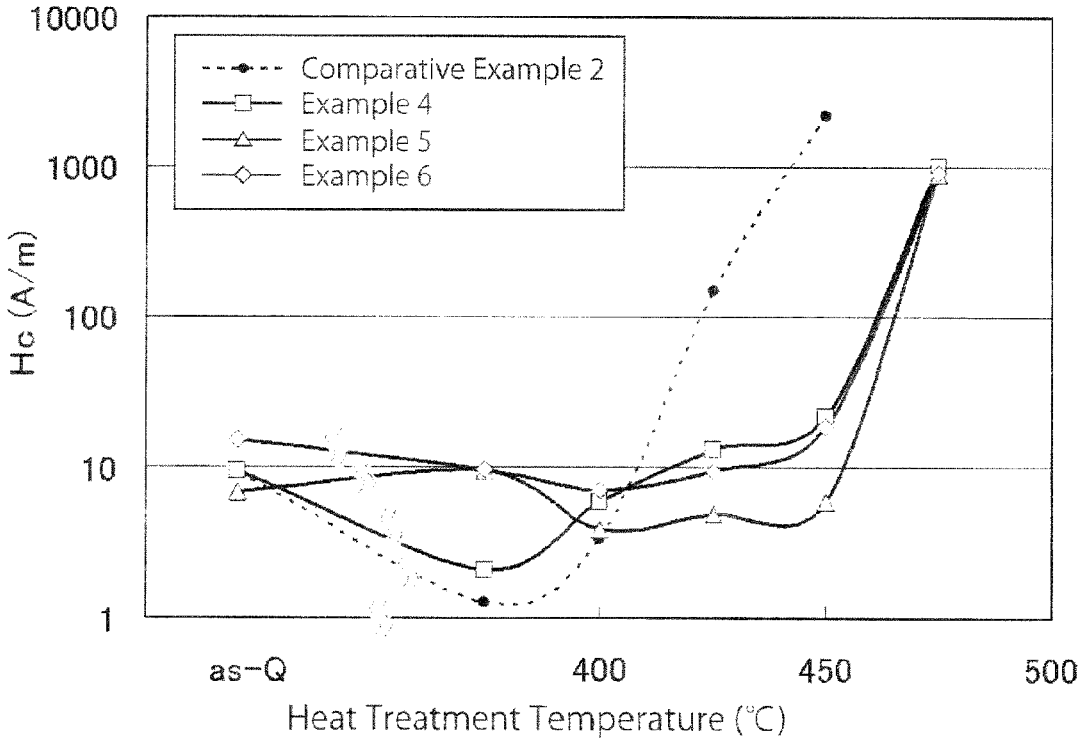
FIG. 1 A view showing relations between coercivity He and heat-treatment temperature for examples of the present invention and comparative examples.

An alloy composition according to an embodiment of the present invention is suitable for a starting material of an Fe-based nano-crystalline alloy. The alloy composition has composition of $Fe_{(100-X-Y-Z)}B_XP_YCu_Z$, wherein the following conditions are met for X, Y and Z of the alloy composition according to the present embodiment: 4≤X≤14 atomic %; 0<Y≤10 atomic %; and 0.5≤Z≤2 atomic %.

It is preferable that the following conditions are met for 100-X-Y-Z, X, Y and Z: 79≤100-X-Y-Z≤86 atomic %; 4≤X≤13 atomic %; 1≤Y≤10 atomic %; and 0.5≤Z≤1.5 atomic %. It is more preferable that the following conditions are met: 82≤100-X-Y-Z≤86 atomic %; 6≤X≤12 atomic %; 2≤Y≤8 atomic %; and 0.5≤Z≤1.5 atomic %. In addition, it is preferable that the ratio of Cu to P meets the condition of 0.1≤Z/Y≤1.2.

A part of Fe of the aforementioned alloy composition may be replaced with at least one element selected from the group consisting of Co and Ni. In this case, the combined total of Co and Ni is 40 atomic % or less relative to the whole composition of the alloy composition, and the combined total of Fe, Co and Ni is 100-X-Y-Z atomic % relative to the whole composition of the alloy composition. Moreover, a part of Fe may be replaced with at least one element selected from the group consisting of Zr, Hf, Nb, Ta, Mo, W, Cr, Ag, Zn, Sn, As, Sb, Bi, Y and rare-earth elements. In this case, the combined total of Zr, Hf, Nb, Ta, Mo, W, Cr, Ag, Zn, Sn, As, Sb, Bi, Y and rare-earth elements is 3 atomic % or less relative to the whole composition of the alloy composition, and the combined total of Fe, Zr, Hf, Nb, Ta, Mo, W, Cr, Ag, Zn, Sn, As, Sb, Bi, Y and rare-earth elements is 100-X-Y-Z atomic % relative to the whole composition of the alloy composition. Moreover, a part of B and/or a part of P may be replaced with C. In this case, the amount of C is 10 atomic % or less relative to the whole composition of the alloy composition, B and P still meet the respective conditions of 4≤X≤14 atomic % and 0≤Y≤10 atomic %, and the combined total of C, B and P is between 4 atomic % and 24 atomic %, both inclusive, relative to the whole composition of the alloy composition.

It is preferable that the following conditions are met for the amounts of Al, Ti, Mn, S, O and N in the aforementioned alloy composition, respectively: Al of 0.5 wt % or less (including zero), Ti of 0.3 wt % or less (including zero), Mn of 1.0 wt % or less (including zero), S of 0.5 wt % or less (including zero), O of 0.3 wt % or less (including zero), and N of 0.1 wt % or less (including zero). It is preferable that the following conditions are met: Al of 0.1 wt % or less (excluding zero), Ti of 0.1 wt % or less (excluding zero), Mn of 0.5 wt % or less (excluding zero), S of 0.1 wt % or less (excluding zero), O of 0.001 to 0.1 wt % (including 0.001 wt % and 0.1 wt %), and N of 0.01 wt % or less (excluding zero). It is more preferable that the following conditions are met: Al of 0.0003 to 0.05 wt % (including 0.0003 wt % and 0.05 wt %), Ti of 0.0002 to 0.05 wt % (including 0.0002 wt % and 0.05 wt %), Mn of 0.001 to 0.5 wt % (including 0.001 wt % and 0.5 wt %), S of 0.0002 to 0.1 wt % (including 0.0002 wt % and 0.1 wt %), O of 0.01 to 0.1 wt % (including 0.01 wt % and 0.1 wt %), N of 0.0002 to 0.01 wt % (including 0.0002 wt % and 0.01 wt %).

In the above alloy composition, the Fe element is a principal component and an essential element to provide magnetism. It is basically preferable that the Fe content is high for increase of saturation magnetic flux density and for reduction of material costs. If the Fe content is less than 79 atomic %, ΔT is reduced, homogeneous nano-crystalline structures cannot be obtained, and desirable saturation magnetic flux density cannot be obtained. If the Fe content is more than 86 atomic %, it becomes difficult to form an amorphous phase under a rapid cooling condition. Crystalline particles have various size diameters or become rough so that the alloy composition has degraded soft magnetic properties. Accordingly, it is desirable that the Fe content is in a range of from 79 atomic % to 86 atomic %. In particular, if high saturation magnetic flux density of 1.7 T or more is required, it is preferable that the Fe content is 82 atomic % or more.

In the above alloy composition, the B element is an essential element to form the amorphous phase. If the B content is less than 4 atomic %, it becomes difficult to form the amorphous phase under the rapid cooling condition. If the B content is more than 14 atomic %, the homogeneous nano-crystalline structures cannot be obtained and compounds of Fe—B are deposited so that the alloy composition has degraded soft magnetic properties. Accordingly, it is desirable that the B content is in a range of from 4 atomic % to 14 atomic %. Moreover, a melting temperature becomes high when the B content is high so that it is preferable that the B content is 13 atomic % or less. In particular, if the B content is in a range of from 6 atomic % to 12 atomic %, the alloy composition has lower coercivity, and it is possible to stably form a continuous strip.

In the above alloy composition, the P element is an essential element to form the amorphous. The P element contributes to stabilization of nanocrystals upon nano-crystallization. If the P content is 0 atomic %, the homogeneous nano-crystalline structures cannot be obtained so that the alloy composition has degraded soft magnetic properties. Accordingly, the P content should be more than 0 atomic %. In addition, if the P content is low, the melting temperature becomes high. Accordingly, it is preferable that the P content is 1 atomic % or more. On the other hand, if the P content is high, it becomes difficult to form the amorphous phase so that homogeneous nano-structures cannot be obtained, and the saturation magnetic flux density is lowered. Accordingly, it is preferable that the P content is 10 atomic % or less. Especially, if the P content is in a range of from 2 atomic % to 8 atomic %, the alloy composition has lower coercivity, and it is possible to stably form the continuous strip.

In the above alloy composition, the C element is an element to form the amorphous. According to the present embodiment, the C element is used together with the B element and the P element so that it is possible to help the formation of the amorphous and to improve the stability of the nanocrystals, in comparison with a case where only one of the B element, the P element and the C element is used. In addition, because the C element is inexpensive, if the content of the other metalloids is relatively lowered by addition of the C element, the total material cost is reduced. However, if the C content becomes 10 atomic % or more, the alloy composition becomes brittle, and the alloy composition has degraded soft magnetic properties. Accordingly, it is desirable that the C content is 10 atomic % or less.

In the above alloy composition, the Cu element is an essential element to contribute to the nano-crystallization. If the Cu content is less than 0.5 atomic %, the crystalline particles become rough in a heat-treatment so that the nano-crystallization becomes difficult. If the Cu content is more than 2 atomic %, it becomes difficult to form the amorphous phase. Accordingly, it is desirable that the Cu content is in a range of from 0.5 atomic % to 2 atomic %. In particular, if the Cu content is 1.5 atomic % or less, the alloy composition has lower coercivity, and it is possible to stably form the continuous strip.

The Cu element has a positive enthalpy of mixing with the Fe element or the B element while having a negative enthalpy of mixing with the P element. In other words, there is a strong correlation between P atom and Cu atom. Therefore, when these two elements are added to each other to be compounded, it becomes possible to form a homogeneous amorphous phase. Specifically, if the specific ratio (Z/Y) of the Cu content (Z) to the P content (Y) is in a range of from 0.1 to 1.2, crystallization and growth of crystal grains are suppressed upon the formation of the amorphous phase under the rapid cooling condition so that clusters of 10 nm or smaller size are formed. These nano-size clusters cause bccFe crystals to have nanostructures upon the formation of the Fe-based nano-crystalline alloy. More specifically, the Fe-based nano-crystalline alloy according to the present embodiment includes the bccFe crystals which have an average particle diameter of 25 nm or smaller. The alloy composition has high toughness by this cluster structure so as to be capable of being flat on itself when being subjected to a 180 degree bend test. The 180 degree bend test is a test for evaluating toughness, wherein a sample is bent so that the angle of bend is 180 degree and the radius of bend is zero. As a result of the 180 degree bend test, the sample is flat on itself or is broken. On the other hand, if the specific ratio (Z/Y) is out of the aforementioned range, the homogeneous nano-crystalline structures cannot be obtained so that the alloy composition cannot have superior soft magnetic properties.

In the above alloy composition, Al is an impurity mixed by using an industrial material. If the Al content is more than 0.50 wt %, it becomes difficult to form the amorphous phase under a rapid cooling in the atmosphere. Rough crystals are deposited also after the heat-treatment so that soft magnetic properties are degraded largely. Accordingly, it is desirable that the Al content is 0.50 wt % or less. In particular, if the Al content is 0.10 wt % or less, it is possible to suppress an increase of viscosity of a molten alloy under the rapid cooling so that a strip having a smooth surface without discoloration is stably formed even under the atmosphere. Moreover, Al has an ability to prevent crystals from becoming rough so that it is possible to obtain the homogeneous nanostructures. Thus, the soft magnetic properties may be improved. With respect to a lower limit, although it is possible to suppress mixing of Al so as to obtain a steady strip and stable soft magnetic properties when a high-purity reagent is used as the industrial material, the material cost becomes high. Meanwhile, when allowing the Al content to be 0.0003 wt % or more, it is possible to use inexpensive industrial materials while not affecting the magnetic properties. Especially, for the present composition, it is possible to improve the viscosity of the molten alloy to stably form the strip having the smooth surface by containing a very small amount of Al.

In the above alloy composition, Ti is an impurity mixed by using the industrial material. If the Ti content is more than 0.3 wt %, it becomes difficult to form the amorphous phase under the rapid cooling in the atmosphere. Rough crystals are deposited also after the heat-treatment so that the soft magnetic properties are degraded largely. Accordingly, it is desirable that the Ti content is 0.3 wt % or less. In particular, if the Ti content is 0.05 wt % or less, it is possible to suppress the increase of viscosity of the molten alloy under the rapid cooling so that the strip having the smooth surface without discoloration is stably formed even under the atmosphere. Moreover, Ti has an ability to prevent crystals from becoming rough so that it is possible to obtain the homogeneous nanostructures. Thus, the soft magnetic properties may be improved. With respect to a lower limit, although it is possible to suppress mixing of Ti so as to obtain the steady strip and the stable soft magnetic properties when a high-purity reagent is used as the industrial material, the material cost becomes high. Meanwhile, when allowing the Ti content to be 0.0002 wt % or more, it is possible to use inexpensive industrial materials while not affecting the magnetic properties. Especially, for the present composition, it is possible to improve viscosity of a molten alloy to stably form the strip having the smooth surface by containing a very small amount of Ti element.

In the above alloy composition, Mn is an unavoidable impurity mixed by using the industrial material. If the Mn content is more than 1.0 wt %, the saturation magnetic flux density is lowered. Accordingly, it is desirable that the Mn content is 1.0 wt % or less. Especially, it is preferable that the Mn content is 0.5 wt % or less to obtain the saturation magnetic flux density of 1.7 T or more. With respect to a lower limit, although it is possible to suppress mixing of Mn so as to obtain the steady strip and the stable soft magnetic properties when a high-purity reagent is used as the industrial material, the material cost becomes high. Meanwhile, when allowing the Mn content to be 0.001 wt % or more, it is possible to use inexpensive industrial materials while not affecting the magnetic properties. Moreover, Mn serves to improve the capability of forming the amorphous so that the Mn content may be 0.01 wt % or more. In addition, it is possible to prevent the crystals from becoming rough and to obtain the homogeneous nanostructures. Therefore, the soft magnetic properties may be improved.

In the above alloy composition, S is an impurity mixed by using the industrial material. If the S content is more than 0.5 wt %, the toughness may be lowered. In addition, the thermal stability is degraded so that the soft magnetic properties after the nano-crystallization are degraded. Accordingly, it is desirable that the S content is 0.5 wt % or less. Especially, if the S content is 0.1 wt % or less, it is possible to obtain the strip having superior soft magnetic properties and narrowly varied magnetic properties. With respect to a lower limit, although it is possible to suppress mixing of S so as to obtain the steady strip and the stable soft magnetic properties when a high-purity reagent is used as the industrial material, the material cost becomes high. Meanwhile, when allowing the S content to be the aforementioned wt % or less, it is possible to use inexpensive industrial materials while not affecting the magnetic properties. S serves to lower the melting temperature and the viscosity in molten state. In particular, containing S of 0.0002 wt % or more is effective to promote spheroidizing of powders when the powders are formed by atomization. Accordingly, it is preferable to contain 0.0002 wt % or more when the powders are formed by atomization.

In the above alloy composition, O is an impurity mixed upon a fusion, under the heat-treatment or by using the industrial material. When the strip is formed by a single-roll liquid quenching method or the like, it is possible to suppress oxidation and discoloration, and to smoothen the surface of the strip by forming it within a chamber having a controllable atmosphere. However, the manufacturing cost becomes high. According to the present embodiment, an inert gas or a reducing gas such as nitrogen, argon or carbonic acid gas is controlled to flow in the atmosphere or to a rapid-cooling portion. Accordingly, it is possible to continuously form the strip having smooth surface condition even in a forming method which causes the O content to become 0.001 wt % or more. Moreover, it is possible to obtain stable magnetic properties. Therefore, it becomes possible to reduce the manufacturing cost drastically. It is similar when the powders are formed by a water atomization method, a gas atomization method or the like. Even for a forming method that causes the O content to become 0.01 wt % or more, it is possible to excellently form a superior surface condition and a spherical shape so as to obtain stable soft magnetic properties. Therefore, it becomes possible to reduce the manufacturing cost drastically. In other words, the O content may be 0.001 wt % or more when the alloy composition is formed in a reducing gas flow. Otherwise, the O content may be 0.01 wt % or more. Moreover, it is possible to perform the heat-treatment in an oxidative atmosphere to form an oxide layer on the surface so as to improve insulation properties and frequency characteristics. According to the present embodiment, if the O content is more than 0.3 wt %, the surface may be discolored, the magnetic properties may be degraded, the lamination factor may be lowered and the formability may be degraded. Accordingly, it is desirable that the O content is 0.3 wt % or less. Especially, because the O element largely affects the magnetic properties of the alloy composition having strip shape, it is preferable that the O content is 0.1 wt % or less.

In the above alloy composition, N is an impurity mixed upon the fusion, under the heat-treatment or by using the industrial material. When the strip is formed by the single-roll liquid quenching method, the inert gas or the reducing gas such as nitrogen, argon or carbonic acid gas is controlled to flow in the atmosphere or to the rapid-cooling portion. Accordingly, it is possible to continuously form the strip having smooth surface condition even for a forming method which causes the N content to become 0.0002 wt % or more. Moreover, upon the heat-treatment for nano-crystallization, it is possible to obtain stable soft magnetic properties even if the heat-treatment is performed not in a vacuum but in an N gas flow. Therefore, it becomes possible to reduce the manufacturing cost drastically. According to the present embodiment, the soft magnetic properties may be degraded if the N content is more than 0.1 wt %. Accordingly, it is desirable that the N content is 0.1 wt % or less.

The alloy composition according to the present embodiment may have various shapes. For example, the alloy composition may have a continuous strip shape or may have a powder shape. The continuous strip-shaped alloy composition can be formed by using an existing formation apparatus such as a single roll formation apparatus or a double roll formation apparatus which is in use to form an Fe-based amorphous strip or the like. The powder-shaped alloy composition may be formed in the water atomization method or the gas atomization method or may be formed by crushing the alloy composition such as the strip.

A high toughness is required to form a wound core or a laminated core, or to perform stamping. In consideration of this high toughness requirement, it is preferable that the continuous strip-shaped alloy composition is capable of being flat on itself when being subjected to the 180 degree bend test under a pre-heat-treatment condition. The 180 degree bend test is the test for evaluating toughness, wherein a sample is bent so that the angle of bend is 180 degree and the radius of bend is zero. As a result of the 180 degree bend test, the sample is flat on itself (O) or is broken (X). In an evaluation described afterwards, a strip sample of 3 cm length was bent at its center, and it was checked whether the strip sample was flat on itself (O) or was broken (X).

The alloy composition according to the present embodiment is formed into a magnetic core such as the wound core, the laminated core or a dust core. The use of the thus-formed magnetic core can provide a component such as a transformer, an inductor, a motor or a generator.

The alloy composition according to the present embodiment has a low melting temperature. The alloy composition is melted by being heated up in an inert atmosphere such as an Ar gas atmosphere so that the endothermic reaction is caused. A temperature at which the endothermic reaction starts is defined as "melting temperature (Tm)". The melting temperature (Tm) can be evaluated through a heat analysis, for example, which is carried out by using a differential thermal analyzer (DTA) apparatus under the condition that a temperature increase rate is about 10° C. per minute.

The alloy composition according to the present embodiment includes Fe, B and P as its essential elements, where the eutectic compositions of Fe with B and P are $Fe_{83}B_{17}$ of high Fe content and $Fe_{83}P_{17}$ of high Fe content, respectively. Therefore, it becomes possible to lower the melting temperature while the alloy composition has high Fe content. Similarly, the eutectic composition of Fe with C is $Fe_{83}C_{17}$ of high Fe content. Therefore, it is also effective to add C so as to lower the melting temperature. Load to the formation apparatus may be reduced by thus lowering the melting temperature. In addition, if the melting temperature is low, it is possible to cool rapidly from a low temperature when forming the amorphous so that the cooling rate becomes faster. Therefore, it becomes easy to form an amorphous strip. Moreover, it is possible to obtain the homogeneous nano-crystalline structures so that the soft magnetic properties may be improved. Specifically, it is preferable that the melting temperature (Tm) is lower than 1150° C. which is a melting temperature of a commercial Fe amorphous.

The alloy composition according to the present embodiment has the amorphous phase as a main phase. Therefore, when the alloy composition is subjected to the heat treatment under an inert atmosphere such as an Ar-gas atmosphere, the alloy composition is crystallized at two times or more. A temperature at which first crystallization starts is defined as "first crystallization start temperature ($T_{x1}$)", and another temperature at which second crystallization starts is defined as "second crystallization start temperature ($T_{x2}$)". In addition, a temperature difference $\Delta T=T_{x2}-T_{x1}$ is between the first crystallization start temperature ($T_{x1}$) and the second crystallization start temperature ($T_{x2}$). Simple terms "crystallization start temperature" means the first crystallization start temperature ($T_{x1}$). These crystallization temperatures can be evaluated through a heat analysis which is carried out by using a differential scanning calorimetry (DSC) apparatus under the condition that a temperature increase rate is about 40° C. per minute.

The alloy composition according to the present embodiment is exposed to the heat treatment under the condition where a process temperature is not lower than the crystallization start temperature (i.e. the first crystallization start temperature) −50° C., so that the Fe-based nano-crystalline alloy according to the present embodiment can be obtained. In order to obtain the homogeneous nano-crystalline structures upon the formation of the Fe-based nano-crystallization alloy, it is preferable that the difference ΔT between the first crystallization start temperature ($T_{x1}$) and the second crystallization start temperature ($T_{x2}$) of the alloy composition is in a range of 70° C. to 200° C.

The thus-obtained Fe-based nano-crystalline alloy according to the present embodiment has low coercivity of 20 A/m or less and high saturation magnetic flux density of 1.60 T or more. Especially, selections of the Fe content (100-X-Y-Z), the P content (X), the Cu content (Z) and the specific ratio (Z/Y) as well as heat treatment conditions can control the amount of nanocrystals so as to reduce its saturation magnetostriction. For prevention of deterioration of the soft magnetic properties, it is desirable that its saturation magnetostriction is $10\times10^{-6}$ or less.

By using the Fe-based nano-crystalline alloy according to the present embodiment, a magnetic core such as a wound core, a laminated core or a dust core can be formed. The use of the thus-formed magnetic core can provide a component such as a transformer, an inductor, a motor or a generator.

An embodiment of the present invention will be described below in further detail with reference to several examples.

Examples 1-15 and Comparative Examples 1-4

Materials were respectively weighed so as to provide alloy compositions of Examples 1-15 of the present invention and Comparative Examples 1-3 as listed in Table 1 below and were melted by a high-frequency heating apparatus. The melted alloy compositions were processed by the single-roll liquid quenching method under the atmosphere so as to produce continuous strips which have a thickness of 20 to 25 μm, a width of about 15 mm and a length of about 10 m. A commercial Fe—Si—B amorphous strip having a thickness of 25 μm was prepared as a Comparative Example 4. For each of the continuous strip of the alloy compositions, phase identification was carried out through the X-ray diffraction method. Their first crystallization start temperatures and their second crystallization start temperatures were evaluated by using a differential scanning calorimetry (DSC). The melting temperatures were evaluated by using the differential thermal analyzer (DTA). Then, the alloy compositions of Examples 1-15 and Comparative Examples 1-4 were exposed to heat treatment processes which were carried out under the heat treatment conditions listed in Table 1. Saturation magnetic flux density Bs of each of the heat-treated alloy compositions was measured by using a vibrating-sample magnetometer (VMS) under a magnetic field of 800 kA/m. Coercivity He of each alloy composition was measured by using a direct current BH tracer under a magnetic field of 2 to 4 kA/m. The measurement results are shown in Tables 1 and 2.

TABLE 1

| | | After Rapid Cooling | | | | | | | |
|---|---|---|---|---|---|---|---|---|---|
| | | | | DSC | | | DTA | Magnetic Properties | |
| | Alloy Composition | (*1) | XRD (*2) | $T_{x1}$ (° C.) | $T_{x2}$ (° C.) | ΔT (° C.) | Tm (° C.) | Hc (A/m) | Bs (T) |
| Example 1 | $Fe_{80.8}B_{12}P_6Cu_{1.2}$ | ○ | Amo | 439 | 523 | 84 | 1035 | 6.9 | 1.58 |
| Example 2 | $Fe_{82.8}B_{11}P_5Cu_{1.2}$ | ○ | Amo | 415 | 527 | 112 | 1048 | 7.1 | 1.55 |
| Example 3 | $Fe_{84.8}B_{10}P_4Cu_{1.2}$ | ○ | Amo | 394 | 531 | 137 | 1067 | 7.3 | 1.58 |
| Comparative Example 1 | $Fe_{82}B_{10}P_8$ | ○ | Amo | 472 | — | 0 | 1047 | 9.3 | 1.55 |
| Example 4 | $Fe_{80.8}B_{10}P_8Cu_{1.2}$ | ○ | Amo | 436 | 509 | 73 | 1033 | 9.5 | 1.55 |
| Example 5 | $Fe_{82.8}B_9P_7Cu_{1.2}$ | ○ | Amo | 413 | 516 | 103 | 1037 | 6.8 | 1.56 |
| Example 6 | $Fe_{84.8}B_8P_6Cu_{1.2}$ | ○ | Amo | 390 | 523 | 133 | 1044 | 15.4 | 1.55 |
| Comparative Example 2 | $Fe_{84.8}B_{14}Cu_{1.2}$ | ○ | Amo | 360 | 501 | 141 | 1174 | 16.3 | 1.59 |
| Example 7 | $Fe_{84.8}B_{13}P_1Cu_{1.2}$ | ○ | Amo | 395 | 517 | 122 | 1129 | 7.0 | 1.55 |
| Example 8 | $Fe_{84.8}B_{12}P_2Cu_{1.2}$ | ○ | Amo | 394 | 530 | 136 | 1113 | 11.3 | 1.54 |
| Example 9 | $Fe_{84.8}B_{11}P_3Cu_{1.2}$ | ○ | Amo | 398 | 529 | 131 | 1087 | 11.0 | 1.60 |
| Example 10 | $Fe_{84.8}B_{10}P_4Cu_{1.2}$ | ○ | Amo | 392 | 530 | 138 | 1067 | 7.3 | 1.58 |
| Example 11 | $Fe_{84.8}B_9P_5Cu_{1.2}$ | ○ | Amo | 393 | 527 | 134 | 1061 | 9.0 | 1.53 |
| Example 12 | $Fe_{84.8}B_8P_6Cu_{1.2}$ | ○ | Amo | 390 | 523 | 133 | 1044 | 15.4 | 1.55 |
| Example 13 | $Fe_{84.8}B_6P_8Cu_{1.2}$ | ○ | Amo | 383 | 508 | 125 | 1040 | 20.4 | 1.56 |
| Example 14 | $Fe_{84.8}B_8P_4C_2Cu_{1.2}$ | ○ | Amo | 383 | 528 | 145 | 1005 | 18.1 | 1.59 |
| Example 15 | $Fe_{69.8}Co_{15}B_{10}P_4Cu_{1.2}$ | ○ | Amo | 394 | 551 | 157 | 1073 | 18.6 | 1.75 |
| Comparative Example 3 | $Fe_{78}P_8B_{10}Nb_4$ | ○ | Amo | 513 | 577 | 64 | 1045 | 17.9 | 1.24 |
| Comparative Example 4 | FeSiB amorphous | ○ | Amo | 523 | 569 | 46 | 1155 | 6.6 | 1.55 |

(*1): Being flat on itself when being subjected to a 180 degree bend test
(*2): Amo: Amorphous; Cry: Crystal

TABLE 2

| | | After Heat Treatment | | |
|---|---|---|---|---|
| | | Magnetic Properties | | |
| | Alloy Composition (at %) | Hc (A/m) | Bs (T) | Heat Treatment Condition |
| Example 1 | $Fe_{80.8}B_{12}P_6Cu_{1.2}$ | 7.6 | 1.67 | 425° C. × 10 Minutes |
| Example 2 | $Fe_{82.8}B_{11}P_5Cu_{1.2}$ | 5.6 | 1.73 | 425° C. × 10 Minutes |
| Example 3 | $Fe_{84.8}B_{10}P_4Cu_{1.2}$ | 7.9 | 1.82 | 425° C. × 10 Minutes |
| Comparative Example 1 | $Fe_{82}B_{10}P_8$ | 151 | 1.60 | 425° C. × 10 Minutes |
| Example 4 | $Fe_{80.8}B_{10}P_8Cu_{1.2}$ | 13.1 | 1.61 | 425° C. × 10 Minutes |
| Example 5 | $Fe_{82.8}B_9P_7Cu_{1.2}$ | 4.9 | 1.70 | 425° C. × 10 Minutes |
| Example 6 | $Fe_{84.8}B_8P_6Cu_{1.2}$ | 9.4 | 1.78 | 425° C. × 10 Minutes |
| Comparative Example 2 | $Fe_{84.8}B_{14}Cu_{1.2}$ | 28.25 | 1.86 | 425° C. × 10 Minutes |
| Example 7 | $Fe_{84.8}B_{13}P_1Cu_{1.2}$ | 19.6 | 1.84 | 425° C. × 10 Minutes |
| Example 8 | $Fe_{84.8}B_{12}P_2Cu_{1.2}$ | 10.5 | 1.81 | 450° C. × 10 Minutes |
| Example 9 | $Fe_{84.8}B_{11}P_3Cu_{1.2}$ | 9.7 | 1.80 | 425° C. × 10 Minutes |
| Example 10 | $Fe_{84.8}B_{10}P_4Cu_{1.2}$ | 7.9 | 1.82 | 425° C. × 10 Minutes |

TABLE 2-continued

| | Alloy Composition (at %) | After Heat Treatment: Magnetic Properties Hc (A/m) | Bs (T) | Heat Treatment Condition |
|---|---|---|---|---|
| Example 11 | $Fe_{84.8}B_9P_5Cu_{1.2}$ | 7.0 | 1.76 | 425° C. × 10 Minutes |
| Example 12 | $Fe_{84.8}B_8P_6Cu_{1.2}$ | 9.4 | 1.78 | 425° C. × 10 Minutes |
| Example 13 | $Fe_{84.8}B_6P_8Cu_{1.2}$ | 11.4 | 1.74 | 425° C. × 10 Minutes |
| Example 14 | $Fe_{84.8}B_8P_4C_2Cu_{1.2}$ | 9.0 | 1.79 | 450° C. × 10 Minutes |
| Example 15 | $Fe_{69.8}Co_{15}B_{10}P_4Cu_{1.2}$ | 15.2 | 1.91 | 425° C. × 10 Minutes |
| Comparative Example 3 | $Fe_{78}P_8B_{10}Nb_4$ | 63.3 | 1.27 | 475° C. × 10 Minutes |
| Comparative Example 4 | FeSiB amorphous | 701 | 1.61 | 525° C. × 10 Minutes |

As understood from Table 1, each of the alloy compositions of Examples 1-15 has an amorphous phase as a main phase after the rapid cooling process and is confirmed to be capable of being flat on itself when being subjected to a 180 degree bend test.

As understood from Table 2, each of the heat-treated alloy composition of Examples 1-15 has superior nano-crystallized structures so as to have high saturation magnetic flux density Bs of 1.6 T or more and low coercivity He of 20 A/m or less. On the other hand, each of the alloy compositions of Comparative Examples 1-4 is not added with one of P and Cu so that the crystals become rough and the coercivity is degraded after the heat treatment. In FIG. 1, the graph of Comparative Example 1 shows that its coercivity He is degraded rapidly as the process temperature increases. On the other hand, the graphs of Examples 4 to 6 show that their coercivities Hc are not degraded even when the heat treatment temperature increases to be more than the crystallization temperature. This effect is caused by nano-crystallization. It is also can be seen from the fact that the saturation magnetic flux density Bs after the heat treatment shown in Table 1 is improved.

As understood from Table 1, each of the alloy compositions of Examples 1-15 has a crystallization start temperature difference $\Delta T$ ($=T_{x2}-T_{x1}$) of 70° C. or more. The alloy composition is exposed to a heat treatment under the condition that its maximum instantaneous heat treatment temperature is in a range between its first crystallization start temperature $T_{x1}$ −50° C. and its second crystallization start temperature $T_{x2}$, so that superior soft magnetic properties (coercivity Hc) can be obtained as shown in Table 2.

As understood from Comparative Example 2 and Examples 7-13 listed in Table 1, when the B content becomes high and the P content becomes low, the melting temperature increases. Especially, the aforementioned effect can be seen clearly when the B content is over 13 atomic % and the P content is less than 1 atomic %. Therefore, P is also indispensable in consideration of forming the strip. It is preferable that the P content is 1 atomic % or more and the B content is 13 atomic % or less. As understood from Table 2, in consideration of magnetic properties, it is preferable that the B content is in a range of from 6 to 12 atomic % and the P content is in a range of from 2 to 8 atomic % so that it is possible to stably obtain low coercivity He of 10 A/m or less. Especially, for the strip-shaped alloy composition, N has a great influence on its magnetic properties. Accordingly, it is preferable that the N content is 0.01 wt % or less.

As understood from Example 14 listed in Tables 1 and 2, even if the C element is added, it is possible to obtain both high saturation magnetic flux density Bs and low coercivity He in spite of having low melting temperature.

As understood from Example 15 listed in Table 2, it is possible to obtain high saturation magnetic flux density Bs over 1.9 T by adding the Co element.

As described above, when the alloy composition according to the present invention is used as a starting material, it is possible to obtain the Fe-based nano-crystalline alloy which has superior soft magnetic properties while having low melting temperature.

Examples 16-59 and Comparative Examples 5-13

Materials were respectively weighed so as to provide alloy compositions of Examples 16-59 of the present invention and Comparative Examples 5-9 and 11-13 as listed in Tables 3 to 5 below and were melted by a high-frequency heating apparatus. The melted alloy compositions were processed by the single-roll liquid quenching method under the atmosphere so as to produce continuous strips which have a thickness of 20 to 25 μm, a width of about 15 mm and a length of about 10 m. A commercial Fe—Si—B amorphous strip having a thickness of 25 μm was prepared as a Comparative Example 10. For each of the continuous strip of the alloy compositions, phase identification was carried out through the X-ray diffraction method. Their first crystallization start temperatures and their second crystallization start temperatures were evaluated by using the differential scanning calorimetry (DSC). The melting temperatures were evaluated by using a differential thermal analyzer (DTA). Then, the alloy compositions of Examples 16-59 and Comparative Examples 5-13 were exposed to heat treatment processes which were carried out under the heat treatment conditions listed in Tables 6 to 8. Saturation magnetic flux density Bs of each of the heat-treated alloy compositions was measured by using the vibrating-sample magnetometer (VMS) under a magnetic field of 800 kA/m. Coercivity He of each alloy composition was measured by using a direct current BH tracer under a magnetic field of 2 to 4 kA/m. The measurement results are shown in Tables 6 to 8.

TABLE 3

| | Composition of Essential Elements (at %) | Trace Element (wt %): Al | Ti | Mn | S | O | N |
|---|---|---|---|---|---|---|---|
| Example 16 | $Fe_{80.8}B_{12}P_6Cu_{1.2}$ | 0.004% | 0.002% | 0.035% | 0.002% | 0.040% | 0.0010% |
| Example 17 | $Fe_{82.8}B_{11}P_5Cu_{1.2}$ | 0.004% | 0.002% | 0.031% | 0.003% | 0.036% | 0.0010% |
| Example 18 | $Fe_{83.3}B_{12}P_4Cu_{0.7}$ | 0.004% | 0.002% | 0.031% | 0.001% | 0.037% | 0.0008% |
| Example 19 | $Fe_{83.3}B_{10}P_6Cu_{0.7}$ | 0.004% | 0.002% | 0.034% | 0.002% | 0.031% | 0.0007% |
| Example 20 | $Fe_{83.0}B_8P_8Cu_{1.0}$ | 0.002% | 0.002% | 0.035% | 0.002% | 0.031% | 0.0009% |

TABLE 3-continued

| | Composition of Essential Elements (at %) | Trace Element (wt %) Al | Ti | Mn | S | O | N |
|---|---|---|---|---|---|---|---|
| Example 21 | $Fe_{84.8}B_{10}P_4Cu_{1.2}$ | 0.003% | 0.002% | 0.021% | 0.005% | 0.031% | 0.0011% |
| Example 22 | $Fe_{86}B_{10}P_3Cu_1$ | 0.004% | 0.002% | 0.024% | 0.003% | 0.040% | 0.0010% |
| Comparative Example 5 | $Fe_{84.8}B_{14}Cu_{1.2}$ | 0.005% | 0.002% | 0.027% | 0.002% | 0.033% | 0.0010% |
| Comparative Example 6 | $Fe_{81.8}B_{16}P_1Cu_{1.2}$ | 0.004% | 0.0024% | 0.0266% | 0.0018% | 0.0326% | 0.0012% |
| Example 23 | $Fe_{83.3}B_{14}P_2Cu_{0.7}$ | 0.005% | 0.002% | 0.031% | 0.006% | 0.036% | 0.0009% |
| Example 24 | $Fe_{84.8}B_{13}P_1Cu_{1.2}$ | 0.006% | 0.002% | 0.027% | 0.003% | 0.033% | 0.0006% |
| Example 25 | $Fe_{84.8}B_{12}P_2Cu_{1.2}$ | 0.005% | 0.002% | 0.027% | 0.004% | 0.033% | 0.0011% |
| Example 26 | $Fe_{84.8}B_{11}P_3Cu_{1.2}$ | 0.003% | 0.002% | 0.026% | 0.005% | 0.033% | 0.0007% |
| Example 27 | $Fe_{84.8}B_{10}P_4Cu_{1.2}$ | 0.003% | 0.002% | 0.026% | 0.006% | 0.033% | 0.0011% |
| Example 28 | $Fe_{84.8}B_9P_5Cu_{1.2}$ | 0.002% | 0.002% | 0.026% | 0.007% | 0.033% | 0.0014% |
| Example 29 | $Fe_{84.8}B_8P_6Cu_{1.2}$ | 0.003% | 0.002% | 0.026% | 0.008% | 0.033% | 0.0008% |
| Example 30 | $Fe_{84.8}B_6P_8Cu_{1.2}$ | 0.001% | 0.001% | 0.026% | 0.010% | 0.034% | 0.0006% |
| Example 31 | $Fe_{85.0}B_4P_{10}Cu_{1.0}$ | 0.002% | 0.001% | 0.026% | 0.012% | 0.034% | 0.0009% |
| Comparative Example 7 | $Fe_{82}B_{10}P_8$ | 0.004% | 0.003% | 0.038% | 0.003% | 0.041% | 0.0006% |
| Comparative Example 8 | $Fe_{83.7}B_{11}P_5Cu_{0.3}$ | 0.004% | 0.002% | 0.031% | 0.007% | 0.036% | 0.0005% |
| Example 32 | $Fe_{83.5}B_{11}P_5Cu_{0.5}$ | 0.004% | 0.002% | 0.031% | 0.007% | 0.036% | 0.0007% |
| Example 33 | $Fe_{83.3}B_{10}P_6Cu_{0.7}$ | 0.004% | 0.002% | 0.034% | 0.002% | 0.031% | 0.0007% |
| Example 34 | $Fe_{83}B_{11}P_5Cu_{1.0}$ | 0.005% | 0.002% | 0.031% | 0.007% | 0.036% | 0.0009% |
| Example 35 | $Fe_{84.8}B_{10}P_4Cu_{1.2}$ | 0.005% | 0.002% | 0.026% | 0.006% | 0.033% | 0.0005% |
| Example 36 | $Fe_{82.5}B_{11}P_5Cu_{1.5}$ | 0.003% | 0.002% | 0.031% | 0.007% | 0.036% | 0.0005% |
| Example 37 | $Fe_{81}B_{12}P_5Cu_{2.0}$ | 0.006% | 0.002% | 0.031% | 0.007% | 0.036% | 0.0007% |

TABLE 4

| | Composition of Essential Elements (at %) | Trace Element (wt %) Al | Ti | Mn | S | O | N |
|---|---|---|---|---|---|---|---|
| Example 38 | $Fe_{83.3}B_{10}P_6Cu_{0.7}$ | 0.004% | 0.002% | 0.034% | 0.002% | 0.031% | 0.0007% |
| Example 39 | $Fe_{83.3}B_{10.8}P_5C_{0.2}Cu_{0.7}$ | 0.005% | 0.002% | 0.030% | 0.007% | 0.036% | 0.0010% |
| Example 40 | $Fe_{83.0}B_4P_{10}C_2Cu_{1.0}$ | 0.001% | 0.001% | 0.027% | 0.012% | 0.034% | 0.0018% |
| Example 41 | $Fe_{83.3}B_8P_3C_5Cu_{0.7}$ | 0.004% | 0.001% | 0.021% | 0.005% | 0.029% | 0.0011% |
| Example 42 | $Fe_{82.2}B_7P_2C_8Cu_{0.8}$ | 0.002% | 0.001% | 0.018% | 0.004% | 0.027% | 0.0009% |
| Example 43 | $Fe_{83.3}B_{10}P_6Cu_{0.7}$ | 0.004% | 0.002% | 0.034% | 0.002% | 0.031% | 0.0007% |
| Example 44 | $Fe_{83.1}B_{10}P_6Cu_{0.7}Cr_{0.2}$ | 0.003% | 0.002% | 0.042% | 0.004% | 0.035% | 0.0008% |
| Example 45 | $Fe_{82.3}B_{10}P_6Cu_{0.7}Cr_1$ | 0.006% | 0.001% | 0.031% | 0.002% | 0.029% | 0.0005% |
| Example 46 | $Fe_{80.3}B_{10}P_6Cu_{0.7}Cr_3$ | 0.005% | 0.001% | 0.011% | 0.004% | 0.031% | 0.0007% |
| Example 47 | $Fe_{83.1}B_{10}P_6Cu_{0.7}Nb_{0.2}$ | 0.004% | 0.003% | 0.051% | 0.010% | 0.051% | 0.0012% |
| Comparative Example 9 | $Fe_{77}B_{10}P_{10}Nb_2Cr_1$ | 0.004% | 0.970% | 0.121% | 0.008% | 0.044% | 0.0010% |
| Comparative Example 10 | FeSiB amorphous | | | | | | |

TABLE 5

| | Composition of Essential Elements (at %) | Trace Element (wt %) Al | Ti | Mn | S | O | N |
|---|---|---|---|---|---|---|---|
| Example 48 | $Fe_{83.3}B_{10}P_6Cu_{0.7}$ | 0.0003% | 0.0002% | 0.001% | 0.0002% | 0.0096% | 0.0002% |
| Example 49 | $Fe_{83.3}B_{10}P_6Cu_{0.7}$ | 0.004% | 0.002% | 0.034% | 0.002% | 0.039% | 0.0007% |
| Example 50 | $Fe_{83.3}B_{10}P_6Cu_{0.7}$ | 0.041% | 0.038% | 0.184% | 0.007% | 0.048% | 0.0006% |
| Example 51 | $Fe_{83.3}B_{10}P_6Cu_{0.7}$ | 0.082% | 0.002% | 0.051% | 0.009% | 0.074% | 0.0024% |
| Example 52 | $Fe_{83.3}B_{10}P_6Cu_{0.7}$ | 0.006% | 0.094% | 0.041% | 0.004% | 0.062% | 0.0019% |
| Example 53 | $Fe_{83.3}B_{10}P_6Cu_{0.7}$ | 0.380% | 0.001% | 0.033% | 0.004% | 0.085% | 0.0081% |
| Example 54 | $Fe_{83.3}B_{10}P_6Cu_{0.7}$ | 0.003% | 0.230% | 0.026% | 0.009% | 0.110% | 0.0076% |
| Comparative Example 11 | $Fe_{83.3}B_{10}P_6Cu_{0.7}$ | 0.510% | 0.920% | 0.120% | 0.014% | 0.180% | 0.0078% |
| Example 55 | $Fe_{83.3}B_{10}P_6Cu_{0.7}$ | 0.003% | 0.001% | 0.140% | 0.008% | 0.036% | 0.0006% |
| Example 56 | $Fe_{83.3}B_{10}P_6Cu_{0.7}$ | 0.002% | 0.001% | 0.490% | 0.006% | 0.032% | 0.0005% |

TABLE 5-continued

| | Composition of Essential Elements (at %) | Trace Element (wt %) | | | | | |
|---|---|---|---|---|---|---|---|
| | | Al | Ti | Mn | S | O | N |
| Example 57 | $Fe_{83.3}B_{10}P_6Cu_{0.7}$ | 0.002% | 0.001% | 0.940% | 0.003% | 0.026% | 0.0007% |
| Comparative Example 12 | $Fe_{83.3}B_{10}P_6Cu_{0.7}$ | 0.002% | 0.001% | 1.520% | 0.010% | 0.024% | 0.0011% |
| Example 58 | $Fe_{83.3}B_{10}P_6Cu_{0.7}$ | 0.002% | 0.001% | 0.042% | 0.082% | 0.034% | 0.0007% |
| Example 59 | $Fe_{83.3}B_{10}P_6Cu_{0.7}$ | 0.002% | 0.001% | 0.021% | 0.440% | 0.042% | 0.0008% |
| Comparative Example 13 | $Fe_{83.3}B_{10}P_6Cu_{0.7}$ | 0.002% | 0.003% | 0.031% | 1.040% | 0.039% | 0.0005% |

TABLE 6

| | Before Heat Treatment | | | | | | | | After Heat Treatment | | |
|---|---|---|---|---|---|---|---|---|---|---|---|
| | XRD | (*1) | Tx1 (° C.) | Tx2 (° C.) | ΔT (° C.) | Tm (° C.) | Hc (A/m) | Bs (T) | Hc (A/m) | Bs (T) | Heat Treatment Condition |
| Example 16 | ○ | ○ | 439 | 523 | 84 | 1035 | 6.9 | 1.58 | 7.6 | 1.67 | 425° C. × 10 Minutes |
| Example 17 | ○ | ○ | 415 | 527 | 112 | 1048 | 7.1 | 1.55 | 5.2 | 1.73 | 450° C. × 10 Minutes |
| Example 18 | ○ | ○ | 420 | 530 | 110 | 1074 | 9.6 | 1.57 | 6.8 | 1.74 | 425° C. × 10 Minutes |
| Example 19 | ○ | ○ | 419 | 522 | 103 | 1053 | 10.8 | 1.56 | 7.4 | 1.73 | 400° C. × 10 Minutes |
| Example 20 | ○ | ○ | 412 | 508 | 96 | 1044 | 9.7 | 1.56 | 6.7 | 1.72 | 400° C. × 10 Minutes |
| Example 21 | ○ | ○ | 394 | 531 | 137 | 1067 | 7.3 | 1.58 | 7.9 | 1.82 | 425° C. × 10 Minutes |
| Example 22 | ○ | ○ | 382 | 533 | 151 | 1085 | 32.2 | 1.53 | 18.8 | 1.83 | 425° C. × 10 Minutes |
| Comparative Example 5 | X | X | 360 | 501 | 141 | 1174 | 16.33 | 1.56 | 28.3 | 1.86 | 425° C. × 10 Minutes |
| Comparative Example 6 | X | X | Could not obtain a continuous strip | | | | | | | | |
| Example 23 | ○ | ○ | 433 | 527 | 94 | 1116 | 10.6 | 1.60 | 12.6 | 1.77 | 425° C. × 10 Minutes |
| Example 24 | ○ | ○ | 395 | 517 | 122 | 1129 | 7.0 | 1.55 | 19.6 | 1.84 | 425° C. × 10 Minutes |
| Example 25 | ○ | ○ | 394 | 530 | 136 | 1113 | 11.3 | 1.54 | 10.0 | 1.81 | 425° C. × 10 Minutes |
| Example 26 | ○ | ○ | 398 | 529 | 131 | 1087 | 11.0 | 1.60 | 9.7 | 1.80 | 425° C. × 10 Minutes |
| Example 27 | ○ | ○ | 392 | 530 | 138 | 1067 | 7.3 | 1.58 | 7.9 | 1.82 | 425° C. × 10 Minutes |
| Example 28 | ○ | ○ | 393 | 527 | 134 | 1061 | 9.0 | 1.53 | 7.0 | 1.76 | 425° C. × 10 Minutes |
| Example 29 | ○ | ○ | 390 | 523 | 133 | 1044 | 15.4 | 1.55 | 9.4 | 1.78 | 425° C. × 10 Minutes |
| Example 30 | ○ | ○ | 383 | 508 | 125 | 1040 | 20.4 | 1.56 | 7.1 | 1.74 | 400° C. × 10 Minutes |
| Example 31 | ○ | X | 374 | 509 | 135 | 1038 | 24.5 | 1.53 | 18.0 | 1.68 | 375° C. × 10 Minutes |
| Comparative Example 7 | ○ | ○ | 474 | N/A | 0 | 1041 | 12.1 | 1.55 | 413 | 1.72 | 400° C. × 10 Minutes |
| Comparative Example 8 | ○ | ○ | 448 | 475 | 27 | 1063 | 12.2 | 1.59 | 302 | 1.72 | 400° C. × 10 Minutes |
| Example 32 | ○ | ○ | 427 | 527 | 100 | 1055 | 13.0 | 1.58 | 16.7 | 1.75 | 425° C. × 10 Minutes |
| Example 33 | ○ | ○ | 419 | 522 | 103 | 1053 | 10.8 | 1.56 | 7.4 | 1.73 | 400° C. × 10 Minutes |
| Example 34 | ○ | ○ | 416 | 525 | 109 | 1058 | 14.0 | 1.57 | 6.5 | 1.72 | 425° C. × 10 Minutes |
| Example 35 | ○ | ○ | 392 | 530 | 138 | 1067 | 7.3 | 1.58 | 7.9 | 1.82 | 425° C. × 10 Minutes |
| Example 36 | ○ | ○ | 388 | 523 | 135 | 1059 | 12.5 | 1.55 | 6.7 | 1.69 | 400° C. × 10 Minutes |
| Example 37 | ○ | X | 374 | 519 | 145 | 1036 | 18.2 | 1.58 | 20.0 | 1.65 | 375° C. × 10 Minutes |

(*1): Being flat on itself when being bent

TABLE 7

| | Before Heat Treatment | | | | | | | | After Heat Treatment | | |
|---|---|---|---|---|---|---|---|---|---|---|---|
| | XRD | (*1) | Tx1 (° C.) | Tx2 (° C.) | ΔT (° C.) | Tm (° C.) | Hc (A/m) | Bs (T) | Hc (A/m) | Bs (T) | Heat Treatment Condition |
| Example 38 | ○ | ○ | 419 | 522 | 103 | 1053 | 10.8 | 1.56 | 7.4 | 1.73 | 400° C. × 10 Minutes |
| Example 39 | ○ | ○ | 420 | 519 | 99 | 1056 | 13.0 | 1.58 | 8.8 | 1.72 | 400° C. × 10 Minutes |
| Example 40 | ○ | ○ | 397 | 498 | 101 | 995 | 11.3 | 1.58 | 7.1 | 1.61 | 400° C. × 10 Minutes |
| Example 41 | ○ | ○ | 411 | 535 | 124 | 1063 | 15.7 | 1.59 | 6.8 | 1.71 | 400° C. × 10 Minutes |
| Example 42 | ○ | ○ | 414 | 517 | 103 | 1068 | 15.9 | 1.59 | 19.2 | 1.70 | 400° C. × 10 Minutes |
| Example 43 | ○ | ○ | 419 | 522 | 103 | 1053 | 10.8 | 1.56 | 7.4 | 1.73 | 400° C. × 10 Minutes |
| Example 44 | ○ | ○ | 419 | 524 | 105 | 1054 | 8.2 | 1.55 | 6.9 | 1.70 | 400° C. × 10 Minutes |
| Example 45 | ○ | ○ | 421 | 525 | 104 | 1056 | 11.2 | 1.51 | 5.8 | 1.68 | 425° C. × 10 Minutes |

TABLE 7-continued

| | Before Heat Treatment | | | | | | | | After Heat Treatment | | |
|---|---|---|---|---|---|---|---|---|---|---|---|
| | XRD | (*1) | Tx1 (° C.) | Tx2 (° C.) | ΔT (° C.) | Tm (° C.) | Hc (A/m) | Bs (T) | Hc (A/m) | Bs (T) | Heat Treatment Condition |
| Example 46 | ○ | ○ | 424 | 532 | 108 | 1062 | 14.5 | 1.39 | 8.6 | 1.60 | 425° C. × 10 Minutes |
| Example 47 | ○ | ○ | 420 | 525 | 105 | 1055 | 9.9 | 1.56 | 6.2 | 1.69 | 425° C. × 10 Minutes |
| Comparative Example 9 | ○ | ○ | 515 | N/A | 0 | 1038 | 6.7 | 1.28 | 5186 | 1.34 | 500° C. × 10 Minutes |
| Comparative Example 10 | ○ | ○ | 523 | 569 | 46 | 1153 | 6.6 | 1.55 | 701 | 1.61 | 525° C. × 10 Minutes |

(*1): Being flat on itself when being bent

15

TABLE 8

| | Before Heat Treatment | | | | | | | | After Heat Treatment | | |
|---|---|---|---|---|---|---|---|---|---|---|---|
| | XRD | (*1) | Tx1 (° C.) | Tx2 (° C.) | ΔT (° C.) | Tm (° C.) | Hc (A/m) | Bs (T) | Hc (A/m) | Bs (T) | Heat Treatment Condition |
| Example 48 | ○ | ○ | 412 | 521 | 109 | 1050 | 14.2 | 1.57 | 6.5 | 1.74 | 425° C. × 10 Minutes |
| Example 49 | ○ | ○ | 419 | 522 | 103 | 1053 | 10.8 | 1.56 | 7.4 | 1.73 | 400° C. × 10 Minutes |
| Example 50 | ○ | ○ | 420 | 525 | 105 | 1055 | 14.4 | 1.55 | 5.5 | 1.72 | 400° C. × 10 Minutes |
| Example 51 | ○ | ○ | 422 | 524 | 102 | 1052 | 14.0 | 1.56 | 9.6 | 1.72 | 425° C. × 10 Minutes |
| Example 52 | ○ | ○ | 421 | 526 | 105 | 1056 | 18.2 | 1.55 | 8.7 | 1.70 | 425° C. × 10 Minutes |
| Example 53 | ○ | ○ | 420 | 522 | 102 | 1054 | 18.0 | 1.56 | 18.8 | 1.71 | 425° C. × 10 Minutes |
| Example 54 | ○ | ○ | 418 | 522 | 104 | 1055 | 25.4 | 1.56 | 14.2 | 1.71 | 425° C. × 10 Minutes |
| Comparative Example 11 | X | X | 408 | 521 | 113 | 1062 | 56.2 | 1.54 | 252 | 1.70 | 400° C. × 10 Minutes |
| Example 55 | ○ | ○ | 416 | 522 | 106 | 1053 | 8.8 | 1.56 | 7.2 | 1.71 | 425° C. × 10 Minutes |
| Example 56 | ○ | ○ | 417 | 521 | 104 | 1050 | 11.5 | 1.55 | 7.6 | 1.70 | 425° C. × 10 Minutes |
| Example 57 | ○ | ○ | 416 | 521 | 105 | 1051 | 13.6 | 1.54 | 6.8 | 1.65 | 400° C. × 10 Minutes |
| Comparative Example 12 | ○ | ○ | 423 | 524 | 101 | 1044 | 10.5 | 1.46 | 15.5 | 1.59 | 375° C. × 10 Minutes |
| Example 58 | ○ | ○ | 418 | 520 | 102 | 1053 | 8.4 | 1.55 | 7.2 | 1.72 | 425° C. × 10 Minutes |
| Example 59 | ○ | ○ | 419 | 521 | 102 | 1052 | 14.4 | 1.53 | 13.4 | 1.66 | 425° C. × 10 Minutes |
| Comparative Example 13 | ○ | X | 418 | 524 | 106 | 1048 | 12.9 | 1.51 | 22.4 | 1.69 | 425° C. × 10 Minutes |

(*1): Being flat on itself when being bent

As understood from Tables 6 to 8, it is confirmed that each of the alloy compositions of Examples 16-59 has an amorphous phase as a main phase after the rapid cooling process. Furthermore, each of the alloy compositions of Examples 16-59 after the heat treatment has superior nano-crystalline structures so that high saturation magnetic flux density Bs of 1.6 T or more and low coercivity He of 20 A/m or less can be obtained. On the other hand, because the alloy composition of Comparative Example 6 contains excessive Fe or B, it does not have enough ability to form the amorphous. After the rapid cooling process, the alloy composition of Comparative Example 6a has a crystalline phase as a main phase and has poor toughness so that the continuous strip cannot be obtained. For the alloy composition of Comparative Example 5, P and Cu of respective proper composition ranges are not added. As a result, after the heat treatment, the alloy composition of Comparative Example 5 has rough crystals and degraded coercivities Hc.

The alloy compositions of Examples 16-22 listed in Table 6 correspond to the cases where the Fe content is varied from 80.8 to 86 atomic %. Each of the alloy compositions of Examples 16-22 listed in Table 6 has saturation magnetic flux density Bs of 1.60 T or more and coercivity He of 20 A/m or less. Therefore, a range of from 80.8 to 86 atomic % defines a condition range for the Fe content. It is possible to obtain saturation magnetic flux density Bs of 1.7 T or more when the Fe content is 82 atomic % or more. Therefore, for a purpose such as a transformer or a motor where high saturation magnetic flux density Bs is required, it is preferable that the Fe content is 82 atomic % or more.

The alloy compositions of Examples 23-31 and Comparative Examples 5 and 6 listed in Table 6 correspond to the cases where the B content is varied from 4 to 16 atomic % and the P content is varied from 0 to 10 atomic %. Each of the alloy compositions of Examples 23-31 listed in Table 6 has saturation magnetic flux density Bs of 1.60 T or more and coercivity He of 20 A/m or less. Therefore, a range of from 4 to 14 atomic % defines a condition range for the B content. A range of from 0 to 10 atomic % (excluding zero atomic %) defines a condition range for the P content. It can be seen that the melting temperature Tm drastically increases when the B content is over 13 atomic % and the P content is less than 1 atomic %. Moreover, from the point of view of forming the strip, the P element which contributes to lower the melting temperature is essential. Accordingly, it is preferable that the B content is 13 atomic % or less, and the P content is 1 atomic % or more. It is preferable that the B content is in a range of 6 to 12 atomic % and the P content is in a range of 2 to 8 atomic % in order to obtain both low He of 10 A/m or less and high Bs of 1.7 T or more.

The alloy compositions of Examples 32-37 and Comparative Examples 7 and 8 listed in Table 6 correspond to the cases where the Cu content is varied from 0 to 2 atomic %. Each of the alloy compositions of Examples 32-37 listed in Table 6 has saturation magnetic flux density Bs of 1.60 T or more and coercivity He of 20 A/m or less. Therefore, a range of from 0.5 to 2 atomic % defines a condition range for the Cu content. If the Cu content is over 1.5 atomic %, the strip becomes brittle so that the strip is uncapable of being flat on itself when bent in 180 degrees. Accordingly, it is preferable that the Cu content is 1.5 atomic % or less.

It can be seen from Examples listed in Table 7 that, even if the C element is added, the melting temperature of the alloy composition is still low, while both high saturation magnetic flux density Bs and coercivity He can be obtained for the Fe-based nano-crystalline alloy obtained after the heat treatment. It can be seen from Examples listed in Table 7 that Fe may be replaced by metallic elements such as Cr or Nb within a range where saturation magnetic flux density is not drastically lowered.

As understood from Tables 6 to 8, for the alloy composition according to the present embodiment, it is possible to obtain high saturation magnetic flux density Bs of 1.60 T or more and low coercivity He of 20 A/m or less when impurities are controlled to include Al of 0.5 wt % or less, Ti of 0.3 wt % or less, Mn of 1.0 wt % or less, S of 0.5 wt % or less, O of 0.3 wt % or less, and N of 0.1 wt % or less. Moreover, Al and Ti contribute to prevent crystal grains from becoming rough when nanocrystals are formed. Therefore, as can be seen from Examples 33-37, a range consisting of Al of 0.1 wt % or less and Ti of 0.1 wt % or less, where coercivity He can be lowered, is preferable. Saturation magnetic flux density is lowered when Mn is added. Therefore, as can be seen from Examples 40-42, it is preferable that the Mn content is 0.5 wt % or less where saturation magnetic flux density Bs becomes 1.7 T or more. Magnetic properties are excellent when each of the S content and the O content is 0.1 wt % or less. Accordingly, it is preferable that each of the S content and the O content is 0.1 wt % or less. As can be seen from Examples 34-44 where inexpensive industrial materials are used, a range consisting of Al of 0.0004 wt % or more, Ti of 0.0003 wt % or more, Mn of 0.001 wt % or more, S of 0.0002 wt % or more, O of 0.01 wt % and N of 0.0002 wt % or more is preferable because it is possible to lower Hc, to obtain a homogeneous strip continuously and to reduce the cost.

As for each of the Fe-based nano-crystalline alloys obtained by exposing the alloy compositions of Examples 16, 17, 19 and 21, its saturation magnetostriction was measured by the strain gage method. As a result, the Fe-based nano-crystalline alloys of Examples 16, 17, 19 and 21 had saturation magnetostriction of $15\times10^{-6}$, $12\times10^{-6}$, $14\times10^{-5}$ and $8\times10^{-6}$, respectively. On the other hand, the saturation magnetostriction of the $Fe_{78}P_8B_{10}Nb_4$ alloy shown in Comparative Example 3 is $17\times10^{-6}$, and the saturation magnetostriction of FeSiB amorphous shown in Comparative Example 4 is $26\times10^{-6}$. In comparison therewith, each of the Fe-based nano-crystalline alloys of Examples 16, 17, 19 and 21 has very small saturation magnetostriction. Therefore, each of the Fe-based nano-crystalline alloys of Examples 16, 17, 19 and 21 has low coercivity and low core loss. Thus, the reduced saturation magnetostriction contributes to improvement of soft magnetic properties and suppression of noise or vibration. Therefore, it is desirable that saturation magnetostriction is $15\times10^{-6}$ or less.

As for each of the Fe-based nano-crystalline alloys obtained by exposing the alloy compositions of Examples 16, 17, 19 and 21 to the heat treatment, its average crystal grain diameter was calculated from TEM photograph. As a result, the Fe-based nano-crystalline alloys of Examples 16, 17, 19 and 21 had average crystal grain diameter of 22 nm, 17 nm, 18 nm and 13 nm, respectively. On the other hand, the average crystal grain diameter of Comparative Example 2 is about 50 nm. In comparison therewith, each of the Fe-based nano-crystalline alloys of Examples 16, 17, 19 and 21 has very small average crystal grain diameter so that each of the Fe-based nano-crystalline alloys of Examples 16, 17, 19 and 21 has low coercivity. Therefore, it is desirable that average crystal grain diameter is 25 nm or less.

As understood from Tables 6 to 8, each of the alloy compositions of Examples 16-59 has a crystallization start temperature difference $\Delta T$ ($=T_{x2}-T_{x1}$) of 70° C. or more. The alloy composition is exposed to the heat treatment under the condition that its maximum instantaneous heat treatment temperature is in a range between its first crystallization start temperature $T_{x1}$ −50° C. and its second crystallization start temperature $T_{x2}$, so that both high saturation magnetic flux density and low coercivity can be obtained as shown in Tables 4 to 6.

The alloy compositions of Examples 43-47 listed in Table 7 correspond to the cases where the Fe content of 0 to 3 atomic % is replaced by Cr or Nb. Each of the alloy compositions of Examples 43-47 listed in Table 7 has saturation magnetic flux density Bs of 1.60 T or more and coercivity He of 20 A/m or less. Thus, within a range preventable the saturation magnetic flux density from being largely lowered, 3 atomic % or less of Fe may be replaced with at least one element selected from the group consisting of Ti, Zr, Hf, Nb, Ta, Mo, W, Cr, Al, Mn, Ag, Zn, Sn, As, Sb, Bi, Y, N, O and rare-earth elements in order to improve the corrosion resistance and to adjust the electric resistance.

Examples 60 and 61 and Comparative Examples 14 and 15

Figure 2:
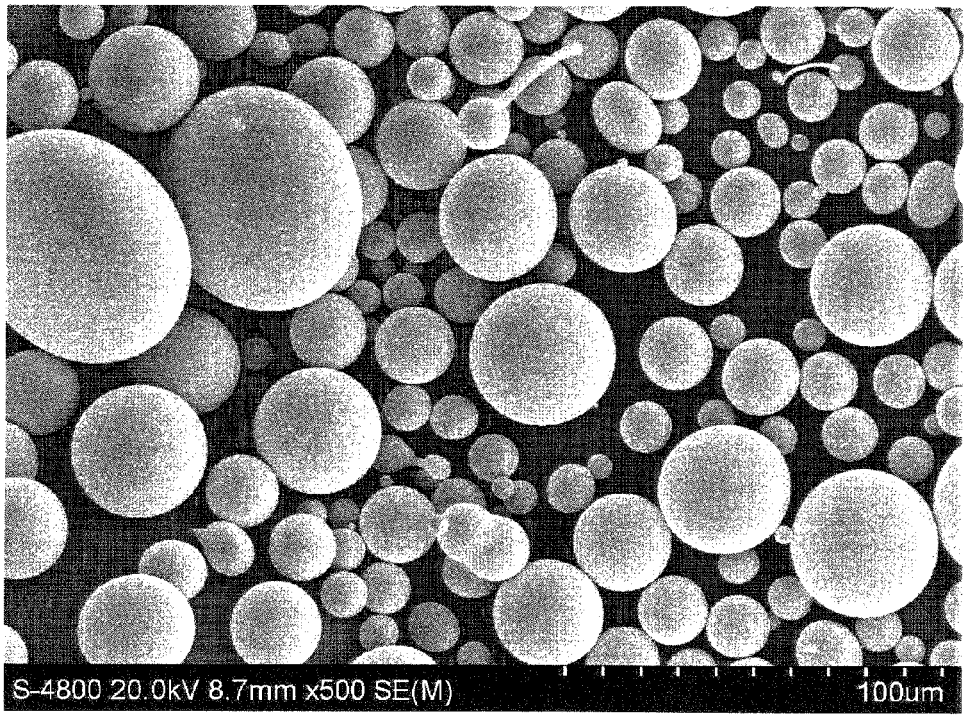
FIG. 2 ASEM photograph of powders of an alloy composition comprising a composition of $Fe_{83.4}B_{10}P_6Cu_{0.6}$, wherein the powders are formed in atomization method.

Materials were weighed so as to provide alloy compositions of $Fe_{83.8}B_8Si_4P_4Cu_{0.7}$ and were processed by the atomization method. Thereby, as shown in FIG. 2, spherical powders having average diameter of 44 μm are obtained. Furthermore, the obtained powders were classified into class of 32 μm or less and class of 20 μm or less by using an ultrasonic classifier so that the powders of Examples 60 and 61 having average diameter of 25 μm and 16 μm, respectively, are obtained. The powders of each Example 60 or 61 were mixed with epoxy resin so that the epoxy resin was of 4.0 weight %. The mixture thereof was put through a sieve of 500 μm mesh so as to obtain granulated powders which had diameters of 500 μm or smaller. Then, by the use of a die that had an inner diameter of 8 mm and an outer diameter of 13 mm, the granulated powders were molded under a surface pressure condition of 10,000 kgf/cm$^2$ so as to produce a molded body that had a toroidal shape of 5 mm height. The thus-produced molded body was cured in a nitrogen atmosphere under a condition of 150° C.×2 hours. Furthermore, the molded body and the powders were exposed to heat treatment processes in an Ar atmosphere under a condition of 375° C.×20 minutes.

Fe—Si—B—Cr amorphous alloy and Fe—Si—Cr alloy were processed by the atomization method to obtain powders of Comparative Examples 14 and 15, respectively. The powders of each of Comparative Examples 14 and 15 had an average diameter of 20 μm. Those powders were further processed to be molded and hardened, similar to Examples 60 and 61. The powders and the molded body of Comparative Example 14 are exposed to heat treatment processes in an Ar atmosphere under a condition of 400° C.×30 minutes without crystallization. Comparative Example 15 was evaluated without the heat treatment.

The crystallization start temperatures and the second crystallization start temperatures of the powders of these alloy compositions were evaluated by using the differential scanning calorimetry (DSC). For the powders of the alloy before or after heat treatment, phase identification was carried out through the X-ray diffraction method. Saturation magnetic flux density Bs of the powders of the alloy before or after heat treatment was measured by using the vibrating-sample magnetometer (VMS) under a magnetic field of 1,600 kA/m. Core loss of each molded body exposed to the heat treatment was measured by using an alternating current BH analyzer under excitation conditions of 300 kHz and 50 mT. The measurement results are shown in Tables 9 and 10.

TABLE 9

| | Composition of Essential Elements (at %) | Trace Element (wt %) | | | | | | Average Diameter of Powders (μm) |
|---|---|---|---|---|---|---|---|---|
| | | Al | Ti | Mn | S | O | N | |
| Example 60 | $Fe_{83.4}B_{10}P_6Cu_{0.6}$ | 0.0017% | 0.0025% | 0.044% | 0.0011% | 0.0895% | 0.0001% | 16 |
| Example 61 | | | | | | | | 25 |
| Comparative Example 14 | FeSiBCr amorphous | | | | | | | 20 |
| Comparative Example 15 | Fe—Si—Cr (crystalline material) | | | | | | | 20 |

TABLE 10

| | Before Heat Treatment | | | | After Heat Treatment | | | |
|---|---|---|---|---|---|---|---|---|
| | Tx1 (° C.) | Tx2 (° C.) | ΔT (° C.) | Bs (T) | Average Diameter of Crystals (nm) | Bs (T) | Pcv (mW/cc) | Heat Treatment Condition |
| Example 60 | 422 | 523 | 101 | 1.58 | 15 nm | 1.71 | 1180 | 425° C. × 10 Minutes |
| Example 61 | 420 | 522 | 102 | 1.58 | 17 nm | 1.72 | 1250 | 400° C. × 10 Minutes |
| Comparative Example 14 | | | | 1.27 | amorpohus | 1.28 | 1900 | 400° C. × 10 Minutes |
| Comparative Example 15 | | | | 1.68 | | 1.68 | 2400 | 425° C. × 10 Minutes |

Figure 3:
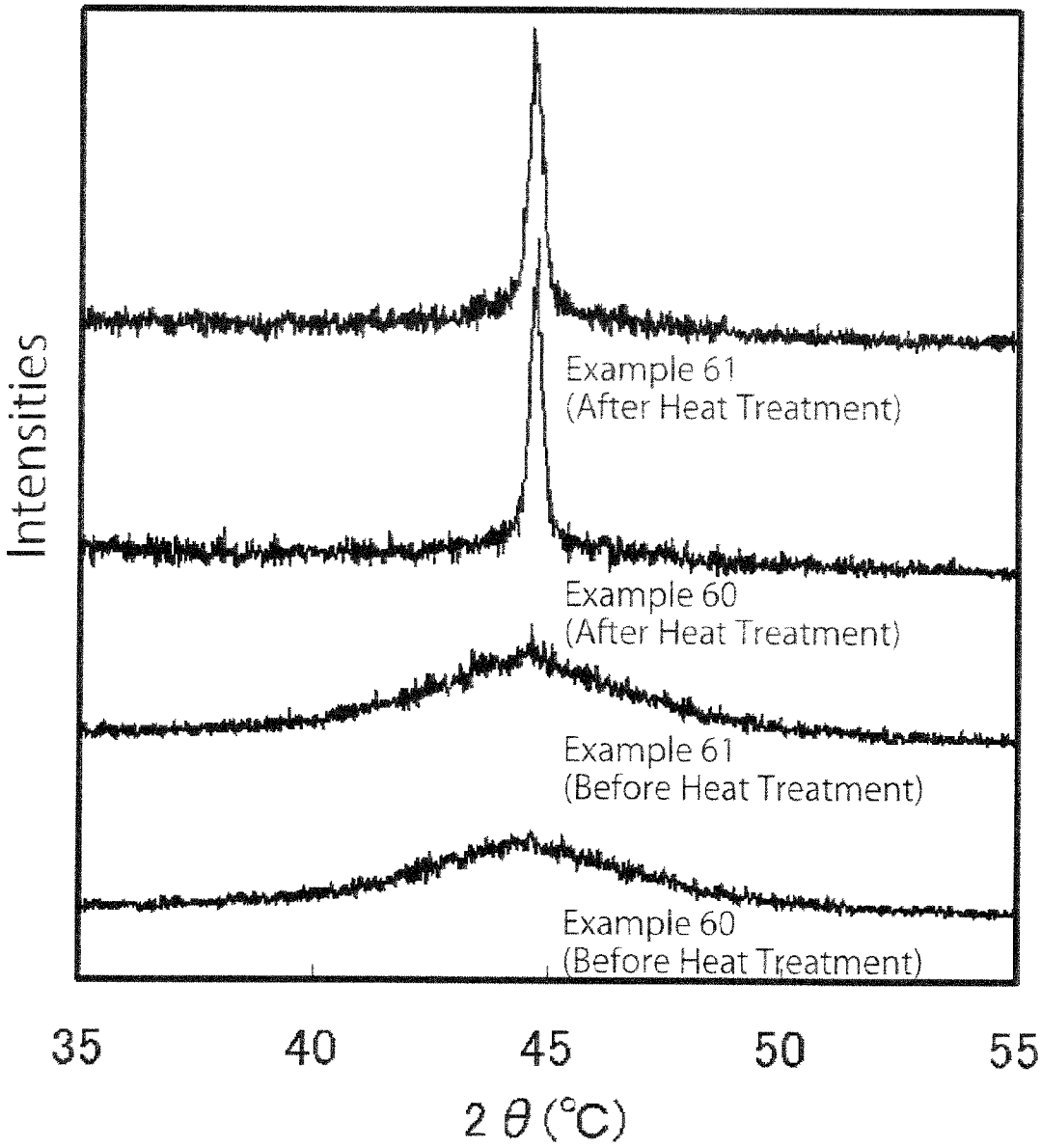
FIG. 3 A view showing XRD profiles of respective powders of the alloy composition comprising a composition of $Fe_{83.4}B_{10}P_6Cu_{0.6}$ under a pre-heat-treatment state or a post-heat-treatment state, wherein the powders are formed in atomization method.

As understood from FIG. 3, the powder-shaped alloy composition of Example 60 has an amorphous phase as a main phase after atomization. A TEM photograph shows that the powder-shaped alloy composition of Example 61 has a nano-hetero structure which comprises initial nanocrystals having an average diameter of 5 nm 10 while the alloy composition has an amorphous phase as a main phase. On the other hand, as understood from FIG. 3, the powder-shaped alloy compositions of Examples 60 and 61 have crystalline phases comprising bcc structures after the heat-treatment. Their average diameters of crystals are 15 nm and 17 nm, respectively. Each of them has nanocrystals having an average diameter of 25 nm or less. As understood from Tables 9 and 10, each of the powder-shaped alloy compositions of Examples 60 and 61 has saturation magnetic flux density Bs of 1.6 T or more. Each of the alloy compositions of Examples 60 and 61 has high saturation magnetic flux density Bs in comparison with Comparative Example 14 (Fe—Si—B—Cr amorphous) and Comparative Example 15 (Fe—Si— Cr). Each of dust cores formed by using the respective powders of Examples 60 and 61 also has low core loss in comparison with Comparative Example 14 (Fe—Si—B—Cr amorphous) and Comparative Example 15 (Fe—Si— Cr). Therefore, the use thereof can provide a magnetic component or device which is small-sized and has high efficiency.

As described above, by using the alloy composition as a starting material, it is possible to obtain an Fe-based nano-crystalline alloy having superior soft magnetic properties while processing easily because of the low melting temperature of the alloy composition.

What is claimed is:

1. An Fe-based nano-crystalline alloy formed from an alloy composition of $(FeE)_{(100-X-Y-Z)}B_XP_YCu_Z$ having an amorphous phase as a main phase, wherein 79≤100-X-Y-Z≤86 atomic %, 4≤X≤9 atomic %, 1≤Y≤10 atomic %, and 0.5≤Z<1.2 atomic %, and wherein (FeE) comprises Fe and at least one element selected from the group consisting of Ti, Zr, Hf, Nb, Ta, Mo, W, Cr, Al, Mn, Ag, Zn, Sn, As, Sb, Bi, Y, N, O and a rare-earth element, wherein a combined total of said at least one element selected from the group consisting of Ti, Zr, Hf, Nb, Ta, Mo, W, Cr, Al, Mn, Ag, Zn, Sn, As, Sb, Bi, Y, N, O and said rare-earth element is in an amount of 3 atomic % or less relative to the whole composition, wherein the Fe-based nano-crystalline alloy has nanocrystals of an average diameter of 5 to 25 nm, and wherein the Fe-based nano-crystalline alloy has a coercivity of 20 A/m or less and a saturation magnetic flux density of 1.6 T or more.

2. The Fe-based nano-crystalline alloy according to claim 1, wherein the alloy composition having a first crystallization start temperature ($T_{x1}$) and a second crystallization start temperature ($T_{x2}$) which have a difference ($\Delta T=T_{x2}-T_{x1}$) of 70 to 200° C.

3. The Fe-based nano-crystalline alloy according to claim 1, wherein the Fe-based nanocrystalline alloy is formed by heating the alloy composition to a temperature in a range of $T_{x1}$ −50° C. to $T_{x2}$ −77° C.

* * * * *